US010482858B2

(12) United States Patent
Stroh et al.

(10) Patent No.: US 10,482,858 B2
(45) Date of Patent: Nov. 19, 2019

(54) GENERATION AND TRANSMISSION OF MUSICAL PERFORMANCE DATA

(71) Applicants: Roland VS LLC, Seattle, WA (US); Roland Corporation, Hamamatsu, Shizuoka (JP)

(72) Inventors: Seth M Stroh, Seattle, WA (US); Ichiro Yazawa, Shizuoka (JP); Jeremy R Soule, Lake Stevens, WA (US); Julian C. Soule, Lake Stevens, WA (US)

(73) Assignees: ROLAND VS LLC, Snohomish, WA (US); ROLAND CORPORATION, Shizuoka (JP)

( * ) Notice: Subject to any disclaimer, the term of this patent is extended or adjusted under 35 U.S.C. 154(b) by 0 days.

(21) Appl. No.: 15/878,251

(22) Filed: Jan. 23, 2018

(65) Prior Publication Data

US 2019/0228754 A1 Jul. 25, 2019

(51) Int. Cl.
*G10H 1/00* (2006.01)
*G10H 1/14* (2006.01)

(52) U.S. Cl.
CPC ..... *G10H 1/0041* (2013.01); *G10H 1/0008* (2013.01); *G10H 1/14* (2013.01); *G10H 2210/066* (2013.01); *G10H 2220/165* (2013.01)

(58) Field of Classification Search
CPC ..... G10H 1/0041
USPC ..... 84/609
See application file for complete search history.

(56) References Cited

U.S. PATENT DOCUMENTS 5,140,890 A * 8/1992 Elion ..... G10H 1/0066 84/736
6,111,186 A * 8/2000 Krozack ..... G10H 3/186 84/733
6,169,240 B1 * 1/2001 Suzuki ..... G10H 7/008 704/503
6,274,799 B1 8/2001 Shimizu
6,353,169 B1 * 3/2002 Juszkiewicz ..... G10H 1/0058 369/4

(Continued)

OTHER PUBLICATIONS

Author unknown; Research and Development Cloud VST; Downloaded from http://www.yamaha.com/about_yamaha/research/cloud-vst; on May 19, 2016; 2 pgs.

(Continued)

*Primary Examiner* — David S Warren
(74) *Attorney, Agent, or Firm* — K&L Gates LLP

(57) ABSTRACT

Systems and methods are generally described for generation and transmission of musical performance data. In some examples, the musical input device may generate a first command encoding a first musical event. In various further examples, the musical input device may generate a first message corresponding to the first command, the first message encoding a first acoustic attribute type of the first musical event. In some examples, the musical input device may generate a second message corresponding to the first command, the second message encoding a second acoustic attribute type of the first musical event. In various examples, the musical input device may generate timestamp data denoting a time of an occurrence of the first musical event. In some examples, the musical input device may send the timestamp data, the first command, the first message and the second message to a computing device.

20 Claims, 13 Drawing Sheets

(56) References Cited

U.S. PATENT DOCUMENTS 6,372,975 B1 * 4/2002 Shinsky ..... G10H 1/0025 84/612
6,448,486 B1 * 9/2002 Shinsky ..... G10H 1/0025 84/613
6,686,530 B2 * 2/2004 Juszkiewicz ..... G10H 1/0058 369/4
6,888,057 B2 * 5/2005 Juszkiewicz ..... G10H 1/0058 84/645
6,995,310 B1 * 2/2006 Knapp ..... G09B 5/065 84/462
7,220,912 B2 * 5/2007 Juszkiewicz ..... G10H 1/0058 84/728
7,220,913 B2 * 5/2007 Juszkiewicz ..... G10H 1/0058 84/645
7,223,912 B2 5/2007 Nishimoto et al.
7,223,913 B2 * 5/2007 Knapp ..... G09B 5/065 84/462
7,241,948 B2 * 7/2007 Cummings ..... G10H 3/188 84/723
7,399,918 B2 * 7/2008 Juszkiewicz ..... G10H 1/0058 84/728
7,420,112 B2 * 9/2008 Juszkiewicz ..... G10H 1/0058 369/4
7,446,253 B2 * 11/2008 Knapp ..... G09B 5/065 84/645
7,563,977 B2 * 7/2009 Cummings ..... G10H 3/188 84/723
7,642,446 B2 * 1/2010 Furukawa ..... H04H 60/16 84/601
7,732,703 B2 * 6/2010 Lazovic ..... G10H 1/0066 84/645
7,799,986 B2 * 9/2010 Ryle ..... G10H 1/053 84/723
7,812,244 B2 * 10/2010 Kotton ..... G10H 3/06 84/615
7,952,014 B2 * 5/2011 Juszkiewicz ..... G10H 1/0058 84/728
8,039,723 B2 * 10/2011 Lazovic ..... G10H 1/0066 84/645
8,093,482 B1 * 1/2012 Kramer ..... A63J 17/00 84/464 A
8,153,878 B2 * 4/2012 Chevreau ..... G10H 1/0025 84/609
8,395,040 B1 * 3/2013 Kramer ..... A63J 17/00 84/643
8,692,101 B2 * 4/2014 Ryle ..... G10H 1/053 84/622
8,697,975 B2 * 4/2014 Iwase ..... G10H 1/0066 84/600
8,716,586 B2 * 5/2014 Thuillier ..... G10H 1/0575 84/723
9,460,695 B2 * 10/2016 Szalay ..... G10H 1/0066
2002/0117044 A1 * 8/2002 Sakurada ..... G10H 1/0058 84/600
2003/0151628 A1 * 8/2003 Salter ..... G09B 5/06 715/773
2003/0172797 A1 * 9/2003 Juszkiewicz ..... G10H 1/0058 84/601
2004/0168566 A1 * 9/2004 Juszkiewicz ..... G10H 1/0058 84/723
2004/0261607 A1 * 12/2004 Juszkiewicz ..... G10H 1/0058 84/645
2005/0172790 A1 * 8/2005 Tada ..... G10H 1/0066 84/645
2006/0107826 A1 * 5/2006 Knapp ..... G09B 5/065 84/724
2006/0252503 A1 * 11/2006 Salter ..... G09B 5/06 463/25
2007/0227344 A1 * 10/2007 Ryle ..... G10H 1/053 84/723
2007/0256551 A1 * 11/2007 Knapp ..... G09B 5/065 84/722
2008/0282873 A1 * 11/2008 Kotton ..... G10H 3/06 84/645
2009/0100991 A1 * 4/2009 Lazovic ..... G10H 1/0066 84/645
2009/0288547 A1 * 11/2009 Lazovic ..... G10H 1/0066 84/645
2010/0242709 A1 * 9/2010 Salter ..... G09B 5/06 84/483.2
2010/0242712 A1 * 9/2010 Lazovic ..... G10H 1/0066 84/645
2010/0313740 A1 * 12/2010 Ryle ..... G10H 1/053 84/735
2011/0023691 A1 * 2/2011 Iwase ..... G10H 1/0066 84/612
2011/0174138 A1 * 7/2011 Loh ..... G10H 1/0066 84/645
2011/0290098 A1 * 12/2011 Thuillier ..... G10H 1/0575 84/645
2013/0160633 A1 * 6/2013 Shrem ..... G10H 1/0075 84/622
2014/0198930 A1 * 7/2014 Thuillier ..... G10H 1/0575 381/98
2014/0202316 A1 * 7/2014 Szalay ..... G10H 1/0066 84/645
2014/0360341 A1 * 12/2014 Dejima ..... G10H 7/002 84/615
2019/0012998 A1 * 1/2019 Nurse ..... G10H 1/386

OTHER PUBLICATIONS

Author unknown; The Complete MIDI 1.0 Detailed Specification; The MIDI Manufacturers Association; 1996; 334 pgs; Los Angeles, CA.
Wright; The Open Sound Control 1.0 Specification opensoundcontrol.org; Mar. 26, 2002; Retrieved from the Internet: URL:http://opensoundcontrol.org/spec-1_0.
Schmeder et al.; Best Practices for Open Sound Control; Linux Audio Conference; May 1, 2010; Utrecht, NL Retrieved from the Internet: URL:http://opensoundcontrol.org/files/osc-best-practices-final.pdf.
Troillard; 0sculator; Jan. 1, 2012; Retrieved from the Internet: URL:https://dl.osculator.net/doc/OSCulator+2.12+Manual.pdf.
Author unknown; User Guide OEM Tripleplay; Jan. 1, 2013; www.fishman.com; Retrieved from the Internet: URL:https://www.fishman.com/wp-content/uploads/2016/09/tripleplay-user-guide-oem.pdf.
De Poli; OSC: Open Sound Control protocol; May 31, 2016; Retrieved from the Internet: URL:https://elearning.dei.unipd.it/pluginfile.php/59467/mod_page/content/46/9_OSC-protocol.pdf.
Author unknown; MIDibox OSC Server/Client; Jan. 5, 2018; Retrieved from the Internet: URL:http://web.archive.org/web/20180105003242/http://www.ucapps.de/midibox_osc.html.
Author unknown; European Search Report of EP19152373.7; dated Jun. 19, 2019; 12 pgs; Munich, Germany.

* cited by examiner

400

| Decimal Value of 8-bit Command | Description |
|---|---|
| 255 | Protocol Reserved Function (Explicit End of Block) |
| 240-254 | System Level Commands |
| 236-239 | System Exclusive Commands |
| 224-235 | Chainable Commands (e.g., Note On, Note Off, Note Modify, Channel Modify, unassigned codes) |
| 129-223 | Common Controls (fast access to commonly used controls) |
| 128 | Protocol Reserved Function |
| 1-127 | Assignable Parameters (Registered and Non-Registered Complex Controls) |
| 0 | Protocol Reserved Function (No Operation) |

FIG. 4

GENERATION AND TRANSMISSION OF MUSICAL PERFORMANCE DATA

FIELD

This application relates to capturing of musical performances and, more specifically, to protocols for generating electronic representations of musical performances.

BACKGROUND

Musical performances may be captured and/or otherwise generated and stored as musical performance data. The Musical Instrument Digital Interface (MIDI) is an example of a technical standard commonly used to represent musical performances to allow for storage of the musical performances and communication of musical performance data between various devices. Musical events generated using MIDI may be sequenced using computer software such as a digital audio workstation (DAW). DAWs typically comprise a centralized computing interface that allows a user to edit and mix one or more recordings to generate a digital representation of a musical performance.

SUMMARY

In accordance with embodiments of the present disclosure, methods of capturing musical performance data are generally described. In at least some examples, the methods may comprise generating, by a musical input device comprising a processor, a first command encoding a first musical event. In at least some other examples, the methods may comprise generating, by the musical input device, a first message corresponding to the first command. In some examples, the first message may encode a first acoustic attribute type of the first musical event and a first acoustic attribute value. In some examples, the first acoustic attribute value may specify a first value of the first acoustic attribute type. In some further examples, the methods may comprise generating, by the musical input device, a second message corresponding to the first command. In various examples, the second message may encode a second acoustic attribute type of the first musical event and a second acoustic attribute value. In some examples, the second acoustic attribute value may specify a second value of the second acoustic attribute type. In yet other examples, the methods may comprise generating, by the musical input device, timestamp data denoting a time of an occurrence of the first musical event. In still further examples, the methods may comprise sending the timestamp data, the first command, the first message, and the second message to a digital audio workstation or other computing device.

In accordance with some other embodiments of the present disclosure, musical instruments are generally described. In various examples, the musical instruments may comprise at least one processor. In some further examples, the musical instruments may comprise at least one sensor effective to detect an input representing a musical event. In various examples, the at least one processor may be effective to generate a digital representation of the musical event based on the input. In some further examples, the at least one processor may be effective to generate time stamp data associated with a timing of the digital representation of the musical event. In some other examples, the at least one processor may be effective to send the digital representation and the time stamp data to a computing device, wherein the computing device is effective to store and edit the digital representation of the musical event.

In accordance with some other embodiments of the present disclosure, computing devices are generally described. In various examples, the computing devices may comprise at least one processor. In some further examples, the computing devices may comprise a sensor effective to detect a performance action. In still further examples, the computing devices may comprise a non-transitory computer-readable medium. In various examples, the non-transitory computer-readable medium may store instructions that, when executed by the at least one processor, may be effective to perform a method comprising generating a first command, the first command encoding a first musical event associated with a performance action detected by the sensor. In some further examples, the method may comprise generating a first message corresponding to the first command. In various examples, the first message may encode a first acoustic attribute type of the first musical event. In various further examples, the method may comprise generating a second message corresponding to the first command. In some examples, the second message may encode a second acoustic attribute of the first musical event. In various further examples, the method may comprise generating timestamp data denoting a time of an occurrence of the first musical event. In yet other examples, the method may comprise sending the timestamp data, the first command, the first message, and the second message to a digital audio workstation or other computing device.

Still other embodiments of the present invention will become readily apparent to those skilled in the art from the following detailed description, wherein are described embodiments by way of illustrating the best mode contemplated for carrying out the invention. As will be realized, the invention is capable of other and different embodiments and its several details are capable of modifications in various obvious respects, all without departing from the spirit and the scope of the present invention. Accordingly, the drawings and detailed description are to be regarded as illustrative in nature and not as restrictive.

BRIEF DESCRIPTION OF DRAWINGS

FIG. 4 depicts groupings of an example command table in accordance with various aspects of the present disclosure.

DETAILED DESCRIPTION

Figure 1:
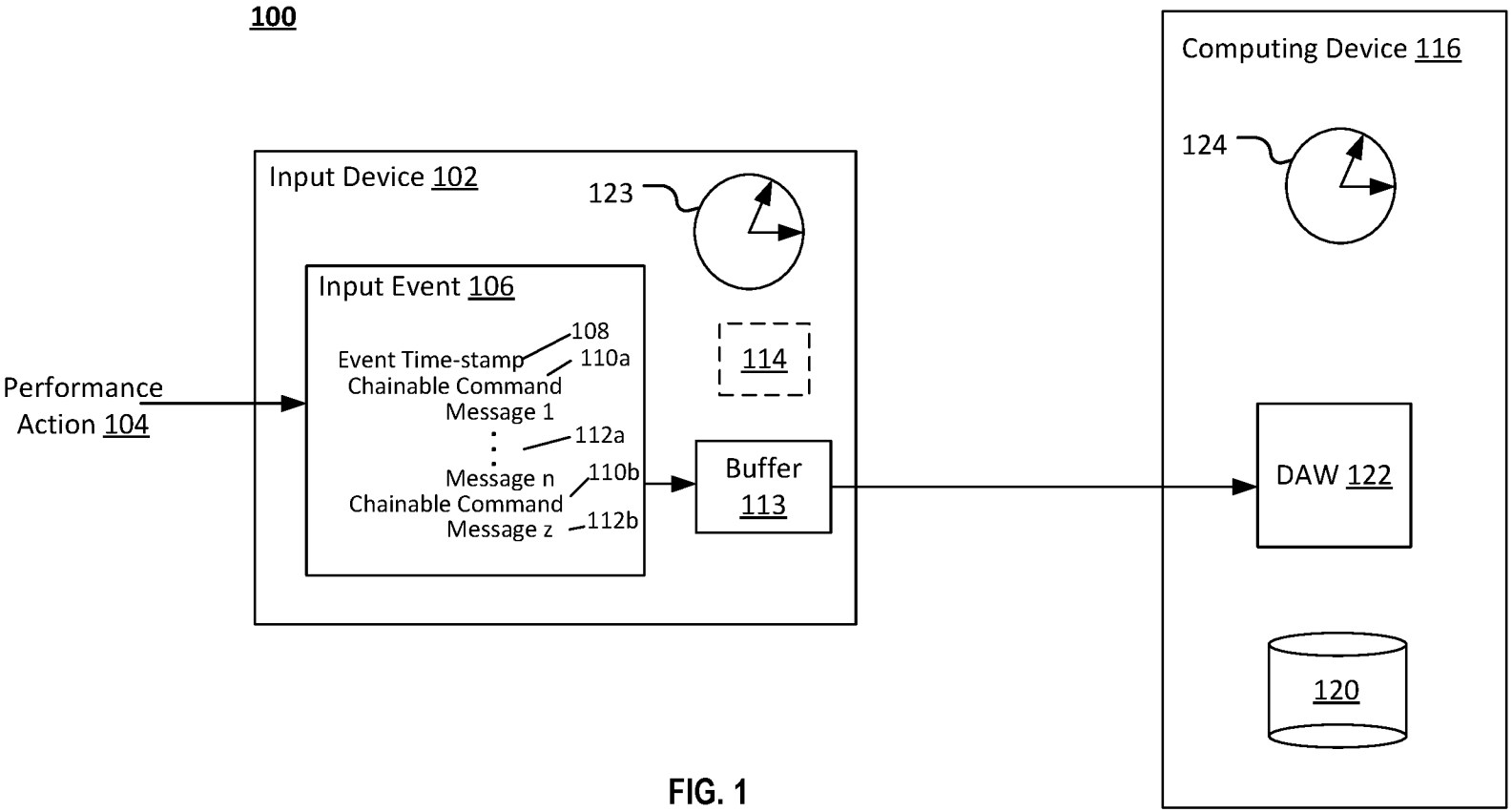
FIG. 1 depicts an example system that may be used to generate and transmit musical performance data, in accordance with various aspects of the present disclosure.

In the following description, reference is made to the accompanying drawings that illustrate several embodiments of the present disclosure. It is to be understood that other embodiments may be utilized and system or process changes may be made without departing from the spirit and scope of the present disclosure. The following detailed description is not to be taken in a limiting sense, and the scope of the embodiments of the present invention is defined only by the claims of the issued patent. It is to be understood that drawings are not necessarily drawn to scale.

Various embodiments of the present disclosure provide improved systems and methods for precise capture and playback of musical performance data. As described herein, these embodiments may provide increased temporal and spatial precision of the capture and playback of musical performance data. Additionally, the various embodiments described herein may provide a standardized manner of specifying individual commands and of chaining multiple commands together to create and edit musical performance data. Additionally, the various embodiments described herein may be effective to associate one or more commands with particular timings to eliminate jitter and to increase the temporal precision of the capture and playback of musical performance data. Additionally, the various embodiments described herein may offer a standardized numerical representation of performance data that is robust enough to represent nuanced musical expressiveness previously unaccounted for and lost in prior systems.

Embodiments described herein may provide approaches to the capture, storage, and transmission of musical performance data with improved temporal precision, spatial precision, and expressiveness of musical performance data. Additionally, embodiments described herein may be expandable and may allow for implementation of advanced features while retaining ease of use and implementation.

As applied to musical performance data, "temporal precision" indicates how accurately in time the actions of a performance are placed. In addition to resolution (how accurately the time of an event can be measured), two additional temporal units of interest in the context of a complete system are latency (the amount of delay between a performance action and the perceived sound) and jitter (the amount of random variation in the latency). Latency may be unavoidable in a musical performance. The speed of sound in air is approximately 1000 feet per second. A guitarist standing 10 feet from a guitar amplifier experiences 10 milliseconds of acoustic latency. In general, a small amount of latency is acceptable to a performer so long as that latency is predictable. A performer "feels" a significant change in latency as a change in tempo. As such, large amounts of timing jitter make a musical performance difficult.

With the advent of digital audio (and more recently the digital audio workstation ("DAW")) a desired performance metric for temporal precision in musical applications has become "sample accuracy." The term "sample accurate" is defined herein as an ability to capture and playback musical data with temporal precision equal to or better than one digital audio sample period. For example, 48 kHz professional audio recordings have a sample period approximately equal to 20 microseconds. Similarly, 96 kHz high resolution audio recordings have a sample period approximately equal to 10 microseconds. The hallmark of a sample accurate system is that a composition or multi-track recording will sound exactly the same each time it is played. The description herein describes systems and methods that can both capture and reproduce a performance with sample accuracy.

The term "digital audio workstation" is defined as a system for composing, recording and/or editing musical content and is typically implemented as software running on a desktop computer equipped with at least one digital audio interface. Modern DAWs achieve sample accuracy when the complete system is limited to the DAW software and the computer it runs on. So long as a composition is entered directly into the DAW software (for example, using musical notation) and the resulting audio is rendered completely within the DAW software, sample accuracy is achieved. Similarly, a musical performance recorded into the DAW in the form of multi-track digital audio also achieves sample accurate playback.

Sample accuracy of the DAW model breaks down when external input devices or external sound generators are integrated into the system to provide performance data to the DAW. These external devices are commonly referred to as "MIDI devices" after the MIDI protocol commonly used for communication between the DAW and the external device. A combination of MIDI protocol and computer operating system limitations can result in significant temporal error in the recording of musical performance data (from an external input device) and in the playback of musical performance data (to an external sound generator). An external sound generator may be, for example, a device effective to receive and play back the musical performance data.

When used to transfer musical performance data between devices, MIDI is strictly a real-time protocol. In other words, a MIDI-enabled input device will attempt to transmit the performance data as close in time as is possible to the input event that generated that data. As a result, the temporal precision achieved is subject to any hardware and software limitations of the input device, any hardware and software limitations of the receiving device and any limitations of the physical connectivity between the devices.

In some MIDI implementations, a DIN MIDI interconnection is used for connectivity between devices. Provided that the interface is idle, transmission of a new event over DIN MIDI can start within one bit-period (with one bit-period being equal to 32 microseconds). While this is not quite sample accurate it does represent very good temporal precision. The primary limitation of DIN MIDI is its relatively low data carrying capacity. Transmission time for a single "note on" event, signaling the start of a musical note, is approximately 320 microseconds. Data is transmitted sequentially and as such truly synchronous events are not possible. For example, playing a three note chord spreads the three individual "note on" events over 960 microseconds. Adding any additional data, such as expression data, further degrades the temporal precision.

Some MIDI devices offer universal serial bus ("USB") as an alternate physical interface to DIN MIDI. Compared to DIN MIDI, USB offers improved data carrying capacity. USB organizes data transfers into frames where the period of a frame is 1000 microseconds. As such, the temporal precision of MIDI over USB may be worse than traditional DIN MIDI. For example, two "note on" events may be generated almost simultaneously but may be split up between two USB frames when transmitted via USB resulting in a temporal error of 1000 microseconds between the two note on events. In some further examples, high speed USB may be used as a physical interface between devices. High speed USB divides the data transfer frame into eight micro-frames with the period of a micro-frame being 125 microseconds. MIDI transferred over high speed USB offers improved temporal precision relative to the 1000 microsecond USB frames, but still falls short of sample accuracy.

In various examples, a second significant source of temporal error exists when the receiving device is a digital audio workstation running in a typical desktop computer environment. The DAW software does not directly receive the musical performance data from the input device. Instead, a device driver within the computer operating system receives the data and places that data into a queue. The queue of data is passed on to the DAW software via an operating system application programming interface (API). When the DAW software is called, the queue may contain several messages with no information as to the relative timing of events that generated those messages introducing further latency and/or jitter.

The limitations of the physical interface and the desktop computer operating system combine to produce a temporal error which includes a significant amount of random jitter, typically with ~1000 microseconds or more of jitter in the complete system. Timestamp enabled MIDI interfaces have been offered as a method of improving temporal precision for MIDI devices used with desktop computers. Such MIDI interfaces are placed between the MIDI devices and the computer running the DAW. Such MIDI interfaces are unable to receive performance actions and generate performance data representing the performance actions and serve only as an interface between an input device or controller and a DAW or computing device. The physical connection from the MIDI interface to the computer is typically a high speed bus such as USB. The connection from the MIDI devices to the MIDI interface is traditional DIN MIDI. The MIDI device itself is unchanged and operates in real-time. As real-time performance data is received at the MIDI interface, the interface applies a timestamp indicating the actual time data was received before passing it on to the computer running the DAW. However, latency and jitter introduced via the physical interface between the MIDI device and the MIDI interface persists.

Spatial Precision

As applied to musical performance data, "spatial precision" indicates how accurately the physical actions of a performance are captured. In other words, spatial precision describes how accurately a parameter associated with a musical event (e.g., speed of note decay, loudness, etc.) is represented. Conceptually, the degree of spatial precision for accurately reproducing a performance is linked to how each type of action affects the resulting sound. For example, the human ear is more sensitive to variation in pitch than variation in volume. It follows that it would be more desirable for actions which affect pitch to be captured with higher precision than actions which affect volume. Accordingly, the various protocols for generation and transmission of musical performance data described herein provide sufficient resolution to capture the most critical actions of a performance.

As with temporal precision, the gold standard for spatial precision has largely been set by the modern digital audio workstation. The DAW environment represents musical performance data as a series of control channels. The numerical representation of controller data within the DAW is typically single precision floating point normalized to 1.0. A single precision floating point value normalized in this way is roughly equivalent to 24 bits of precision.

Historically, the MIDI protocol addressed the transmission of performance data originating from a piano style keyboard often augmented with additional controls such as pitch and modulation wheels and/or foot pedals. As such, the MIDI protocol is built around note event messages (note on, note off) where the messages convey a note number (which key was pressed) and a note velocity (how fast the key was moving.) The MIDI protocol was developed in the era of 8-bit microprocessors and, as such, uses 8-bits as its basic data word length. MIDI reserves 1-bit as a start of message flag leaving 7-bits for parameter data. Critical parameters are sent using two data words resulting in 14-bits of extended precision.

For key velocity, the 7-bits of precision provided by MIDI was reasonable for early applications. More recently it has been suggested that to faithfully reproduce the dynamic range of an acoustic piano, approximately 10-bits of precision for hammer velocity should be used. To represent the dynamic range of an orchestra using a single "velocity" scale (with the goal of preserving the relative balance of individual instruments) an additional increase in resolution is may be used.

For relative pitch adjustment (pitch bend) the 14-bits of extended precision provided by MIDI may be sufficient. Pitch bend is applied over a relatively small range of frequencies (an octave or less) resulting in a perceived continuous change in pitch. That is, the resulting steps in frequency are small enough (a fraction of a musical cent) so as not to be perceived. To directly specify the pitch of notes to be played or for controls that adjust pitch over a wide range of frequencies, additional resolution may be used. Examples of such controls include filter and equalizer frequency adjustment as well as the direct assignment of note pitch for the realization of alternate temperament or of microtonal scales.

Expressiveness

As applied to musical performance data, "expressiveness" (or note expression) indicates how accurately the articulation in a performance can be captured. As an example, a performance on a stringed instrument may include articulation of specific notes or of notes played on a specific string. Similarly, a stringed instrument may be played with a particular style of attack such as bowed, picked, or plucked. Although expressiveness in a musical context is not a new concept, capturing musical expression as performance data that is straightforward and intuitive to edit is a new endeavor. As used herein, the "capture" of musical performance data may include encoding a musical performance as one or more commands and/or messages.

Most DAWs are unable to capture and manipulate musical expression at the level of individual notes. Attempting this normally entails the use of a workaround, such as separating the notes requiring specific articulation onto separate tracks within the DAW. At a minimum, this type of workaround is non-intuitive and editing the result is difficult.

As previously stated, the MIDI protocol developed around the transmission of performance data originating from a piano-style keyboard. Beyond key velocity, MIDI includes a single parameter (poly after-touch) for the modification of specific playing notes. All other MIDI parameters (such as pitch bend) target all of the notes playing on a channel. As such, applying the MIDI protocol to other types of instruments can be difficult. As with the DAW, the most common workaround is to separate notes with unique articulation onto their own MIDI channel. In the case of stringed instruments each string is separated onto its own channel. Accordingly, instead of seeing a single sequence of notes on one guitar track in the DAW, six separate tracks are generated resulting in performance data that may be difficult and unwieldy to edit. Additionally "poly expression" musical controllers are input devices that track the position, motion and pressure of individual fingers on a control surface as a source of expressive performance data. To transmit data from such a controller using MIDI separates each distinct touch onto its own channel. Again, the resulting data is non-intuitive and difficult to edit once captured.

Numerical Representation

As previously described, MIDI uses 8-bit word length. In various examples, the protocol described herein may use 32-bits as the standard word length. In an example 32-bit implementation, the upper 8-bits may encode a command (or indication of the type of data carried) and the lower 24-bits may encode the command parameters or performance data. Due to the prevalence of 32 bit and 64 bit microprocessors, 32 bit words may be easily parsed by modern computing systems. In various examples, a 32 bit word length may also represent a good match to the internal controller precision of a typical DAW environment. Where more than 24-bits of precision is desired, a multi-word message may be utilized. Although 32 bit words are generally described herein for illustrative purposes, the various techniques for generation and transmission of musical performance data described herein may be used with different data word lengths. In various examples, a suitable word length may be selected based on the particular computing environment used to implement the various techniques described herein.

FIG. 1 depicts an example system 100 that may be used to generate and transmit musical performance data, in accordance with various aspects of the present disclosure. In some examples, system 100 may comprise an input device 102 and a computing device 116. Input device 102 may be a computing device, including at least one processor and memory, used to generate performance data and/or to send performance data to the DAW 122 of computing device 116. In at least some examples, input device 102 may be a controller or instrument capable of receiving a performance action 104 and generating an input event, such as input event 106, in response to the performance action 104. In at least some examples, input device 102 may comprise and/or may be configured in communication with an optional digital audio interface (not shown in FIG. 1). In various examples, the digital audio interface may match clock speeds between input device 102 and computing device 116. Additionally, the digital audio interface may receive audio from an external source. In some examples, the digital audio interface may be effective to pass received audio to computing device 116.

Input device 102 may be effective to monitor sensors of input device 102 for new performance input (e.g., performance action 104). For example, in guitars and other stringed instruments, the sensors may comprise pickup devices that sense mechanical vibrations produced by the instrument, and the performance action may comprise a strumming of the guitar strings. In electric keyboards, the sensors may comprise an array of sensors, and the performance action may comprise the performer's pressing of a key. Additionally, in various examples, input device 102 may apply timestamps (e.g., timestamp 108) based on a clock local to input device 102 (e.g., clock 123). In various examples, clock 123 may be synchronized with one or more other clocks in system 100. Input device 102 may be further effective to format input events into the various messages (including, for example, commands and encoded parameters) described in the present disclosure. Input device 102 may be further effective to transmit the messages to a computing device (e.g., computing device 116). In various examples, the computing device 116 may or may not comprise a DAW. In at least some examples, the computing device 116 may comprise at least one processor effective to receive and interpret the various encoded musical data received from input device 102. In at least some examples, the computing device 116 may be, or may be configured in communication with, an external sound generator capable of playing back musical performance data. In at least some further examples, computing device 116 may be a device effective to store, edit and/or forward musical performance data, in accordance with various embodiments.

Performance action 104 may be used to generate input event 106. Input events 106 may be stored in buffer 113 prior to transmission to DAW 122 of computing device 116. DAW 122 may provide an interface for editing the various input events received from one or more external sources such as from input device 102. Musical performance data (which may comprise multiple input events and external audio sources) may be displayed on a graphical user interface provided by DAW 122 for editing and/or playback. The musical performance data may be stored in memory 120 of computing device 116. Additionally, musical performance data may be output by computing device 116 to one or more external devices for playback and/or storage of the musical performance data.

Computing device 116 may comprise one or more device drivers associated with input device 102. Device drivers may detect the attachment or coupling of an input device such as input device 102 and may perform device-specific configuration tasks. The device driver may provide a standard API to the DAW (e.g., DAW 122). In at least some examples, the device driver may perform the clock discipline function described herein in reference to FIGS. 5-11. In various other examples where input devices are connected via a network connection, the host application (e.g., DAW 122) may open a direct (network socket) connection to the input device to receive input events formatted in accordance with the present disclosure.

The DAW 122 (or another host application of computing device 116) may allow selection of one or more input devices. Input events (e.g., input event 106) formatted in accordance with the various techniques described herein may be received by DAW 122 via a standardized API when the input device is connected to the computing device 116 through a wired connection. In various other examples, a network-attached input device may connect with DAW 122 (or another host application of computing device 116) using standard network protocols. In various examples, DAW 122 (or another host application of computing device 116) may be effective to store messages, performance data and/or input events in memory 120 of computing device 116 and/or in one or more cloud-based storage repositories.

Temporal Precision

Various systems for generation and transmission of musical performance data described herein may achieve temporal precision using a combination of timestamps and the structured representation of performance data. The timestamp may convey the time of an occurrence of a musical event (e.g., the time a musical event was captured or the time at which a musical event is intended to play) whereas the structured representation may allow related pieces of data to be grouped for synchronous interpretation within a single timestamped block of commands.

For example, input event 106 of FIG. 1 comprises an event timestamp 108, a chainable command 110*a*, a message set 112*a* (including messages 1-*n*), a chainable command 110*b* and a message set 112*b* (including message z). Event timestamp 108 may associate a time with the messages and/or commands in the block for which timestamp 108 is generated. For example, input event 106 may comprise a block of commands including two chainable commands 110*a*, 110*b*, with each chainable command being associated with a number of messages. As used herein, a "chainable command" may refer to an executable command and to one or more parameters associated with the chainable command (e.g., including chain data comprising an indication of the number of messages associated with (or "chained to") the chainable command). Messages may comprise first data encoding an acoustic attribute type describing a type of musical event encoded by the executable command of the message. Additionally, messages may comprise second data encoding one or more acoustic attribute values specifying a value (e.g., a parameter) of the acoustic attribute type of the message. For example, a first message may comprise the acoustic attribute type "initial pitch". In at least some examples, a first number of bits of the first message may encode the acoustic attribute type. A DAW or other computing device configured in accordance with the various techniques described herein may be effective to interpret the acoustic attribute type as describing the initial pitch of a musical event encoded by the first message. Further, the first message may comprise second data encoding the acoustic attribute value "445 Hz". In the example, a second number of bits of the first message may encode the value of 445 Hz. In the example, the 445 Hz may specify the value of the acoustic attribute type (e.g., "initial pitch") of the first message. Messages may or may not be associated with or "chained to" a chainable command. Timestamp 108 may specify a time at which chainable commands 110*a*, 110*b* were captured or at which musical events represented by chainable commands 110*a*, 110*b* should be played. As discussed in further detail below, timestamps may be generated by reference to one or more clocks of system 100. For example, clock 123 may be a local clock of input device 102 and may be used to generate timestamp 108. In various other examples, local clock 123 of input device 102 may be synchronized with clock 124 of computing device 116. The local clock (e.g., clock 123) of an input device (e.g., input device 102) may be used to generate timestamp data (e.g. timestamp 108). In some instances, a local clock of an input device may be disciplined to follow a reference clock external to the input device 102 (e.g., clock 124), but the local clock would still be used to generate timestamp 108.

In an example implementation, timestamps may be generated by the device that generates the input event. For example, in FIG. 1, input device 102 may generate timestamp 108. In the case of an input device, the input device may apply timestamps to performance data before that data is passed on to other devices in the system. In the case of a DAW, the DAW may apply timestamps to performance data before that data is passed on to an external (output) device.

Figure 2:
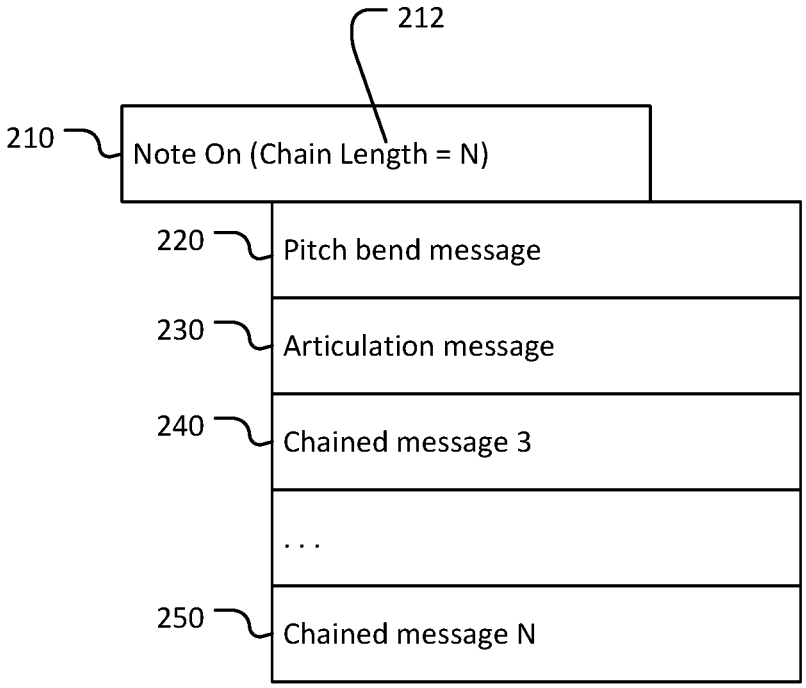
FIG. 2 depicts an example structured representation of performance data that may be used in accordance with various aspects of the present disclosure.

FIG. 2 depicts an example structured representation of performance data that may be used in accordance with various aspects of the present disclosure. FIG. 2 depicts a "note on" chainable command 210. In various examples, a "note on" chainable command describes a musical event that has been captured (and/or should be played back) at a particular time. A "note on" chainable command 210 may specify a particular note captured (and/or that should be played) at a particular time. In various examples, chainable commands (e.g., chainable commands 110*a*, 110*b* of FIG. 1) may comprise a chain-length parameter to specify the number of messages that modify the particular chainable command. For example, "note on" chainable commands may comprise a chain-length parameter 212 to specify the number of messages that modify the "note on" chainable command 210. In the example depicted in FIG. 2, chain-length parameter 212 specifies a chain length of N messages (e.g., messages 220, 230, 240, . . . , 250). In the example depicted in FIG. 2, pitch bend message 220 may specify an initial pitch of the note of "note on" chainable command 210. Similarly, articulation message 230 may specify a particular articulation of the note (e.g., plucked or bowed if the note is played on a violin) of "note on" chainable command 210. As previously described, in a 32-bit implementation, the upper 8 bits of each message may encode a command and the lower 24 bits may encode the command parameters or performance data. Using pitch bend message 220 as an example, the upper 8 bits of pitch bend message 220 may indicate that the message is used to specify the initial pitch of the note encoded by the "note on" chainable command 210. The lower 24 bits of pitch bend message 220 may specify the particular pitch (e.g., using fractions of a musical cent). Although multiple messages are depicted in association with chainable command 210, any number of messages (including a single message) may be used in accordance with the present disclosure.

Figure 3:
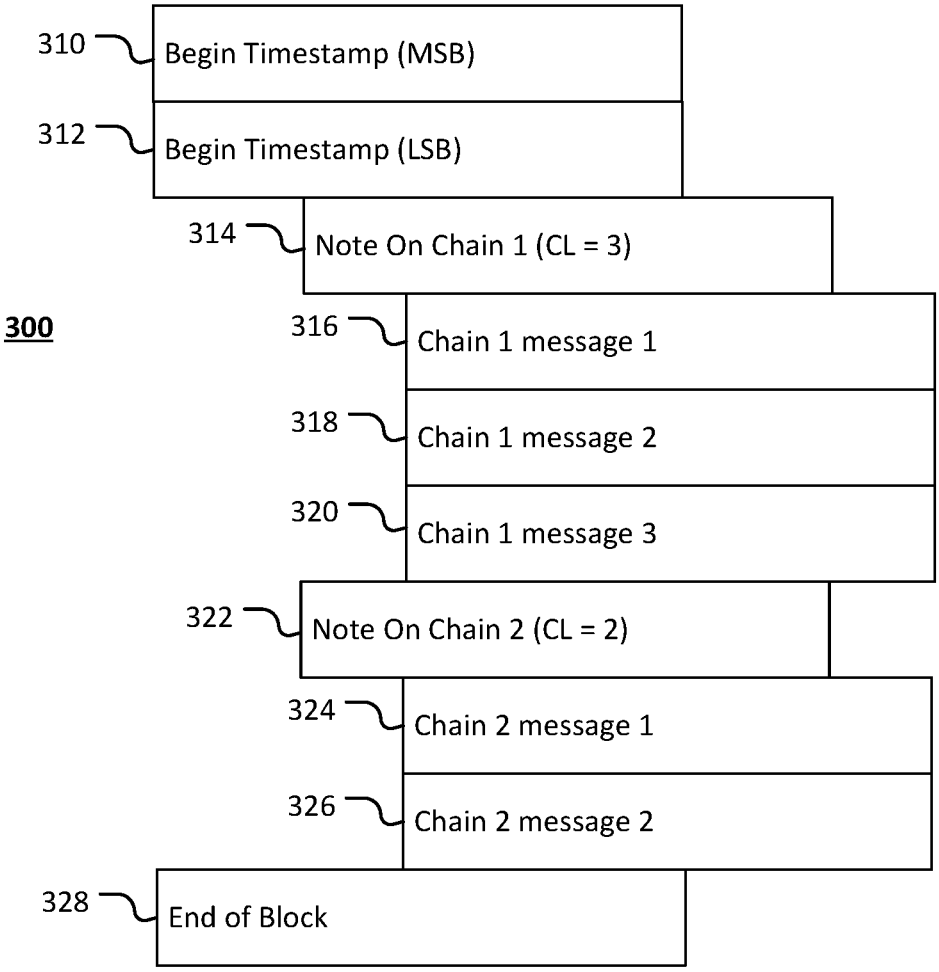
FIG. 3 depicts an example structured representation of a block of timestamped performance data, in accordance with various aspects of the present disclosure.

FIG. 3 depicts an example structured representation of a block of timestamped performance data, in accordance with various aspects of the present disclosure. In various examples, a master clock may be used in system 100 (FIG. 1) to which devices in the system may be synchronized. A master clock may be a "wall clock" or a "media clock." In both clock formats, time is represented in double-word extended precision where the "upper" word conveys integer seconds and the "lower" word conveys fractions of a second. A single-word offset based timestamp may also be included to reduce overhead when a large number of small data blocks are transmitted at a regular interval.

The "wall clock" format conveys traditional time of day in extended precision. The IEEE 1588 "Precision Time Protocol" specifies a method for the distribution of such an extended precision wall clock. In an example implementation, the lowest 6 bits of the IEEE 1588 clock may be truncated resulting in a timestamp granularity of 64 nanoseconds for wall clock format.

The "media clock" format conveys time in relation to the word clock (sample clock) of a digital audio system (e.g., the word clock of digital audio interface 114 of FIG. 1). In an example media clock format, the 8th most significant bit of the timestamp fraction may be equal to one sample period for a single rate (48 kHz) professional audio system, the 7th most significant bit of the timestamp fraction is equal to one sample period of a double rate (96 kHz) high resolution audio system, etc. The example implementation described above results in a timestamp granularity of approximately 81 nanoseconds for media clock format.

FIG. 3 depicts a timestamped block of messages 300. Timestamp 312 may represent integer seconds and timestamp 314 may represent fractions of a second. Together timestamps 312 and 314 may represent the time at which the performance data encoded within the timestamped block of messages 300 was captured or should be played back to within the tolerances described above (e.g., to within 64 or 81 nanoseconds, depending on the type of clock implementation). The timestamped block of messages 300 comprises two "Note On" chainable commands 314 and 322. Accordingly, timestamped block of messages 300 encodes two notes being played at the same time. Note On event action 314 comprises a chain length (CL) of 3 messages—316, 318 and 320. As described above in reference to FIG. 2, each of the 3 messages 316, 318 and 320 may modify the note encoded by Note On chainable command 314. Similarly, Note On event action 322 comprises a CL of 2 messages—324 and 326. As described above in reference to FIG. 2, each of the messages 324 and 326 may modify the note encoded by Note On chainable command 322. Message 328 indicates an explicit end to timestamped block of messages 300.

Musical Expression Data

At the fundamental level, a protocol that encapsulates musical performance data conveys the start of any new sound to be produced as well as any subsequent modifications of that sound up to and including the termination of the sound. When a new sound begins to play or an already playing sound is modified, the protocol conveys performance data unique to that sound. Finally, in order to encapsulate a complete composition, a method of grouping (or channelizing) related sounds (or instruments) may be used in accordance with the various embodiments described herein.

In the various systems and methods for the generation and transmission of musical performance data described herein, related sounds (a single instrument or single melodic line of a complete composition) may be organized into channels. To better accommodate non-keyboard oriented instruments, the various systems and methods for the generation and transmission of musical performance data described herein includes sub-channels. That is, each channel can be further divided into several sub-channels. Taking stringed instruments as an example, each string of a stringed instrument may be assigned its own sub-channel. Additionally, in the example, the performance of the stringed instrument may be generated for a first channel, such that the overall performance is defined by a single channel, while the portion of the performance attributable to a particular string is generated for a particular sub-channel of the stringed instrument's channel. Generation of sub-channels for each string may be particularly useful as the same note (same pitch) may be played on more than one string but with slightly different tonality based upon that selection. Similarly, a modern "poly-expression" controller may assign each distinct touch to its own sub-channel.

As previously described, in an effort to maximize expressiveness, the various systems and methods described herein may use the concept of a command chain of commands and messages, as shown and described in reference to FIGS. 2 and 3, for example. In various examples, the chainable commands (e.g., chainable commands 110*a*, 110*b* of FIG. 1) may define a set of basic commands (note on, note off, note modify, channel modify) and may allow an arbitrary set of parameters to be associated with (chained to) each of these basic commands. Whereas MIDI transmits a fixed set of parameters (note number and velocity) with the start and end of a sound, the various techniques described herein allow the set of parameters transmitted to be instrument or performance specific. Accordingly, the various techniques described herein may allow any aspect of a sound to be specified at the time the sounds begin to play. Additionally, any aspect of an already-playing sound may be modified at any point in time up to and including at the termination of that sound using the structured representation of data described herein.

In addition to the more common parameters used to shape the characteristics of a sound (such as pitch or loudness), the various systems and methods described herein add the concept of articulation instructions (sometimes referred to herein as "articulation hints") to further the expressiveness of the performance data. Articulation hints may include instructions effective to encode the type of attack when a new sound starts (for example, plucked or bowed for a stringed instrument) as well as common modifications to a sound (for example, muting of a percussion instrument such as a cymbal). For example, with reference to FIG. 3, event action 314 may be a "note on" chainable command comprising messages 316, 318 and 320. Message 316 may specify an initial pitch of the note on a violin. Message 318 may be an articulation hint to indicate that the musician's bow is moving upward or downward to more faithfully reproduce the expressiveness of the musical performance.

As previously described, in MIDI, if individual note-level expression is desired, notes requiring unique articulation are separated onto their own channel. In the case of stringed instruments each string is separated onto its own channel. Accordingly, instead of seeing a single sequence of notes on one guitar track in the DAW, six separate tracks are generated resulting in performance data that may be difficult and unwieldy to edit. By contrast, in the various systems and methods described herein, note-level expression may be achieved while retaining a single channel for performance by the particular instrument or controller.

Finally, in addition to note level expression described above, a channel modify command allows addressing of all notes playing on a channel or sub-channel. Channel-level controls lack flexibility and granularity but remain useful for many applications in which multiple notes are to be modified in the same way.

Expandability

In various examples, some consideration may be provided as to how the various systems and methods described herein can be made adaptable to new applications. FIG. 4 depicts groupings of an example command table 400 in accordance with various aspects of the present disclosure.

First, the command table may be broken into logical sections and unassigned codes are reserved within those sections where new commands are most likely to be added. For example, the chainable commands section currently includes note on, note off, note modify and channel modify but a range of unassigned codes may be reserved should new types of chainable commands be used. Further, several codes in the command table may be reserved for compatibility with anticipated physical interfaces. For example, certain codes are reserved as an easily recognized preamble in stream oriented interfaces.

In various examples, the various systems and methods described herein may include the concept of extended (paged) parameter sets. In some examples, such extended parameter sets may be referred to as "Registered Complex Controls" (for natively-defined parameters) and "Non-Registered Complex Controls" (for freely-assignable parameters). In some examples, each class of complex control may address up to 65,536 pages where each page may contain up to 127 parameters for a total of 16 million uniquely addressable parameters.

Miscellaneous Features

In various examples, the systems and methods described herein may include additional useful features such as a parameter read-back request. As the name suggests, this command normally requests that an input device or controller return the current state of the parameter indicated. In addition to querying for current state, it is also possible to use the read-back request for automatic discovery of input device/controller capabilities. Examples of information that may be returned to the DAW through the read-back request may include: minimum and maximum range implemented for each control, the step size or resolution implemented for each control, a text label describing the function of each control, etc. Read-back request functionality enables an easier "plug and play" end user experience particularly for devices that implement a large set of extended parameters.

Alternate Applications

Although discussed above in relation to musical performance data, the functionality described above may also be used to capture and transmit data tangentially related to music. Examples include equipment automation within a traditional recording studio environment, control surfaces used for tactile control of a DAW, live performance applications, etc. Live performance itself may include equipment automation, stage lighting, video and other media where each element may (or may not) be synchronized to a scripted timeline or to a live performance.

Implementation

Various implementations of the protocols, systems and methods described above may comprise an input device coupled to a computing device. The input device may be any device used to capture musical performance data. In various examples, the input device may be a musical instrument or a controller device. In at least some examples, musical instruments used as input devices may comprise one or more processors effective to generate the various data described above as performance data. For example, a musical instrument in accordance with various aspects of the present disclosure may comprise a microprocessor effective to generate timestamp data and the various commands discussed above in association with the timestamp data. The input device may be coupled to a computing device executing a DAW. In various examples, the computing device may be used to store, edit, and/or transmit the captured data. In at least some examples, a digital audio interface may be used and may be interposed in a communication link between the input device and the computing device. In various other examples, the input device may interface directly with the computing device.

In some examples, input devices, as described herein, may comprise a traditional musical instrument, instrumented with sensors to capture the actions of a musical performance. In some further examples, input devices may comprise a dedicated controller styled after a traditional musical instrument for the capture of a musical performance, but that does not produce sound of its own. In some further examples, input devices may comprise a dedicated controller of unique design (not styled after a traditional musical instrument) for the capture of a musical performance and that may or may not produce sound of its own.

In various examples, computing devices, as described herein, may comprise one or more desktop or laptop computers. In some further examples, computing devices, as described herein, may comprise one or more mobile computing devices such as a tablet or smart phone. In still further examples, computing devices may comprise a dedicated computing device for executing a DAW (e.g., a music workstation).

In some examples, as described herein, a digital audio interface may be effective to convert audio to and/or from a digital representation. In various examples, digital audio interfaces, as described herein may comprise a digital audio interface integrated into a computing device. In yet other examples, a digital audio interface as described herein may comprise a digital audio interface integrated into an input device. In still further examples, a digital audio interface may comprise a digital audio interface peripheral attached to the computing device and configured in communication with an input device. For example, the clock of the input device may be disciplined to follow the clock of the digital audio interface.

In various examples, the "Event Timestamp" depicted in FIGS. 5-10 may be an example of the commands described herein with reference to FIGS. 1-4. Additionally, in various examples, the instances of the term "Parameter" depicted in FIGS. 5-10 may be examples of commands and/or messages (either of which may include parameter values) as described above in reference to FIGS. 1-4. Further, in various examples depicted in FIGS. 5-11, "CD" may refer to a clock-disciplining signal effective to synchronize one or more clocks to a reference clock.

Figure 5:
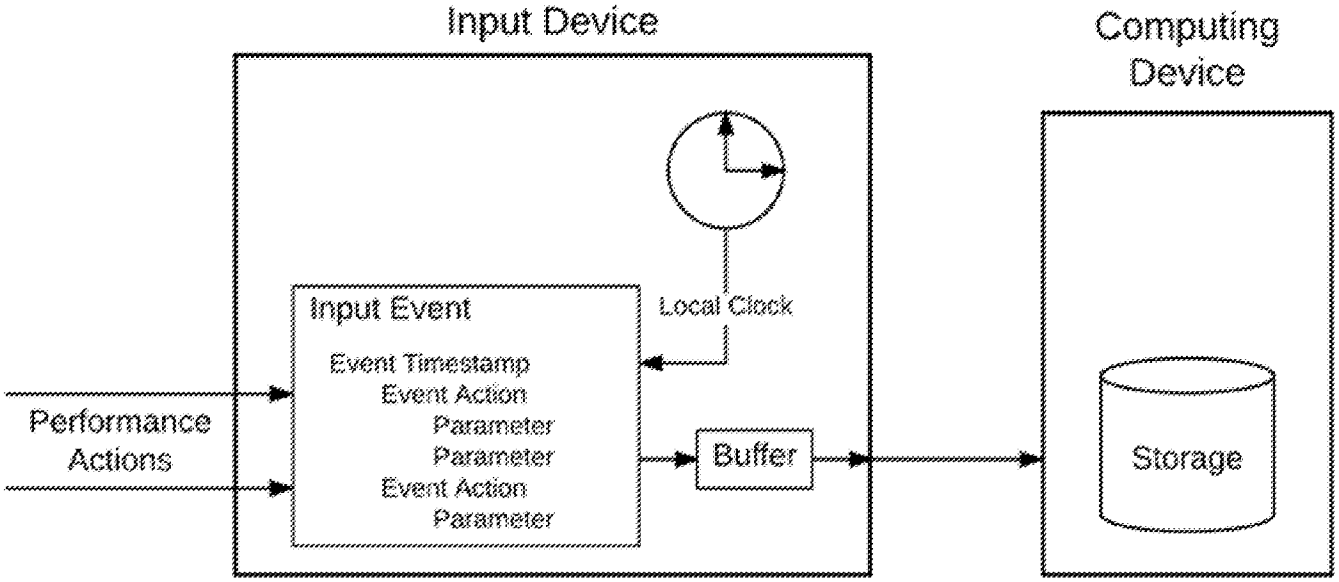
FIG. 5 depicts an example implementation wherein timestamps reference a clock local to an input device, in accordance with an embodiment of the present disclosure.

FIG. 5 depicts an example implementation where timestamps reference a clock local to an input device, in accordance with an embodiment of the present disclosure. In some examples, an input device may be coupled to a computing device where timestamps reference a clock local to that input device.

Figure 6:
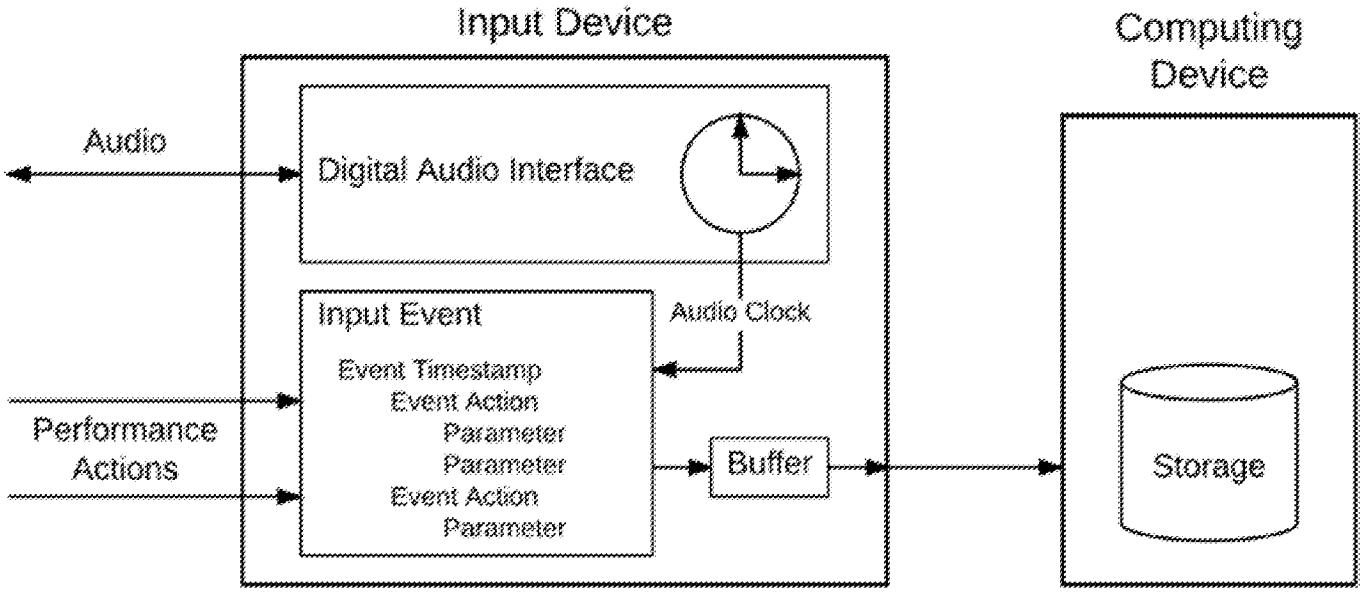
FIG. 6 depicts an example implementation wherein timestamps reference a digital audio clock local to an input device, in accordance with an embodiment of the present disclosure.

FIG. 6 depicts an example implementation where timestamps reference a digital audio clock local to an input device, in accordance with an embodiment of the present disclosure. In the example depicted in FIG. 6, the input device includes a digital audio interface function. In at least some examples, timestamps generated by the input device may reference the digital audio clock of the digital audio interface local to the input device.

Figure 7:
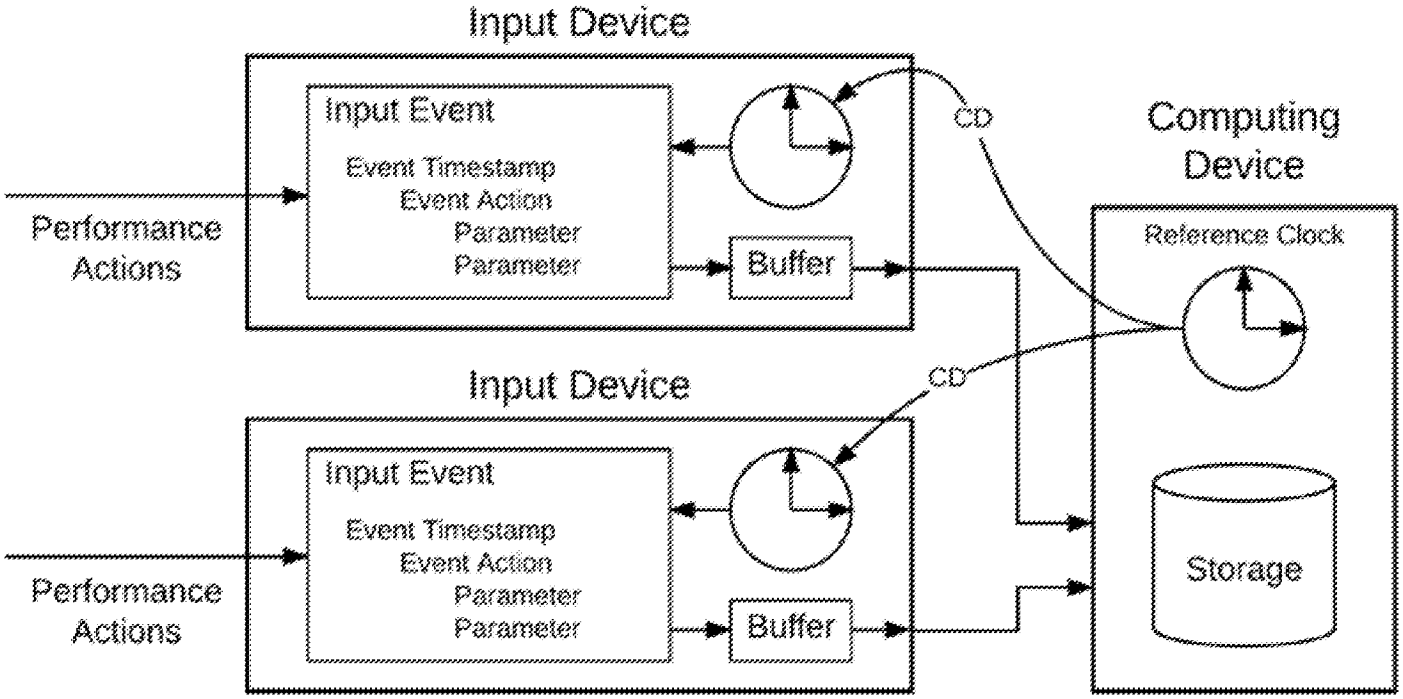
FIG. 7 depicts an example implementation wherein a clock local to the computing device is used as the clock reference, in accordance with various aspects of the present disclosure.

FIG. 7 depicts an example implementation where a clock local to the computing device is used as the clock reference, in accordance with various aspects of the present disclosure. Timestamps generated by each input device depicted in FIG. 7 may reference a clock local to the input device. As depicted in FIG. 7, the clock of each input device may be disciplined to follow the reference clock using a CD signal.

Figure 8:
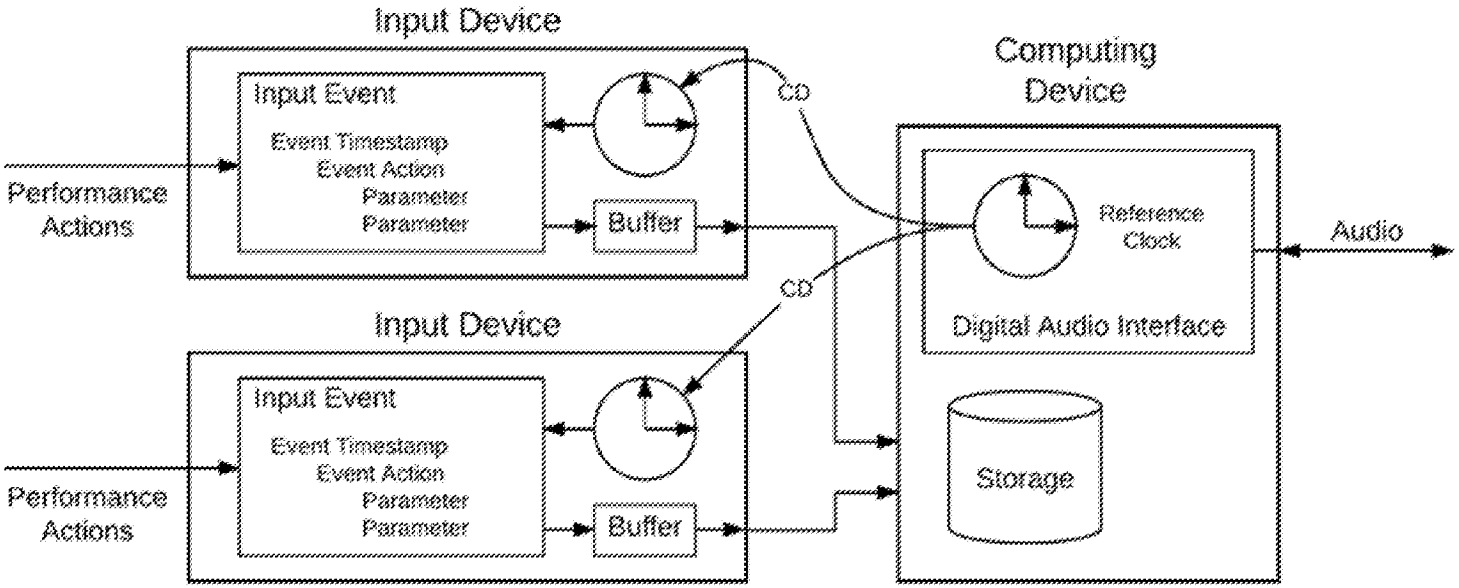
FIG. 8 depicts an example implementation wherein the computing device comprises a digital audio interface function and the digital audio clock of the digital audio interface is used as a reference clock, in accordance with various aspects of the present disclosure.

FIG. 8 depicts an example implementation where the computing device comprises a digital audio interface function and the digital audio clock of the digital audio interface is used as a reference clock, in accordance with various aspects of the present disclosure.

Figure 9:
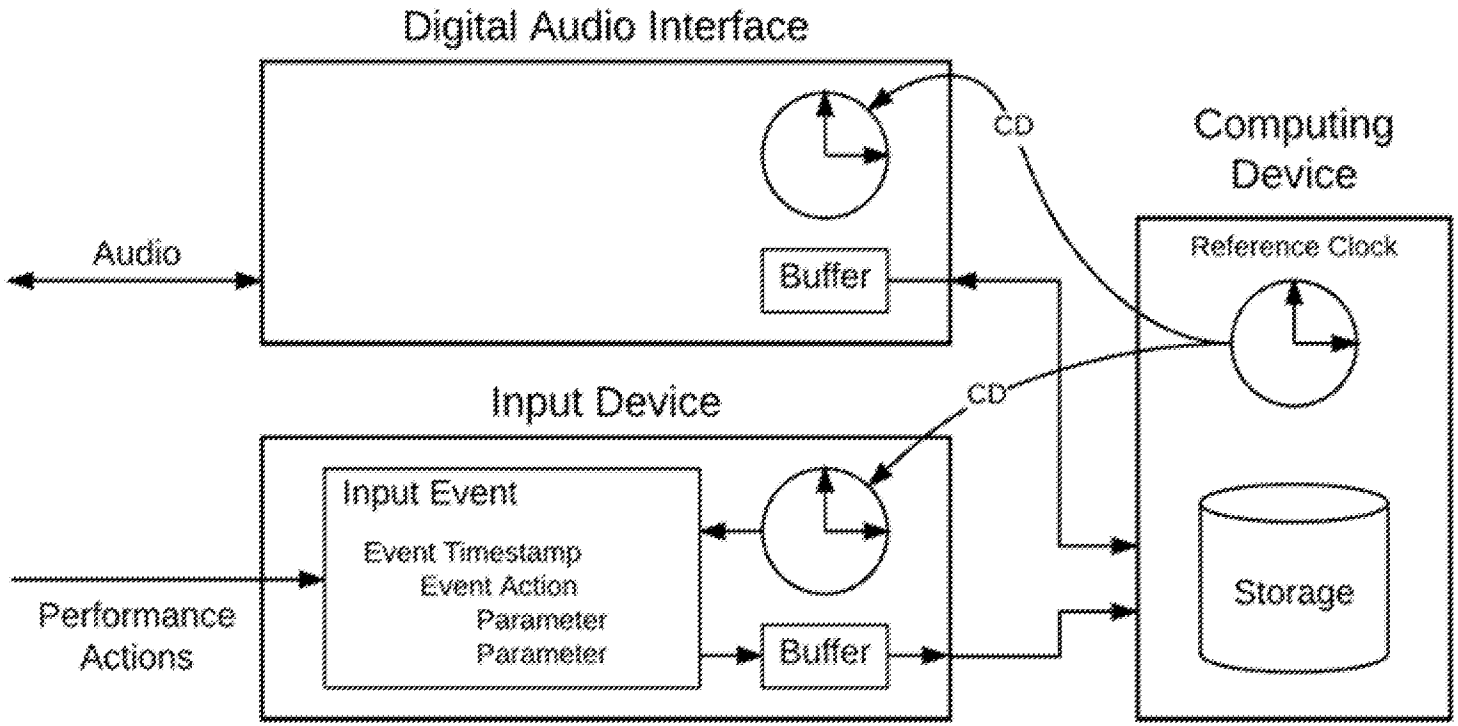
FIG. 9 depicts an example implementation wherein a dedicated digital audio interface peripheral is coupled to the computing device, in accordance with various aspects of the present disclosure.

FIG. 9 depicts an example implementation wherein a dedicated digital audio interface peripheral is coupled to the computing device, in accordance with various aspects of the present disclosure. In the example depicted in FIG. 9, a clock local to the computing device is used as the reference and the local clock of the attached input device and local clock of the digital audio interface peripheral are disciplined to follow the local clock of the computing device using CD signals.

Figure 10:
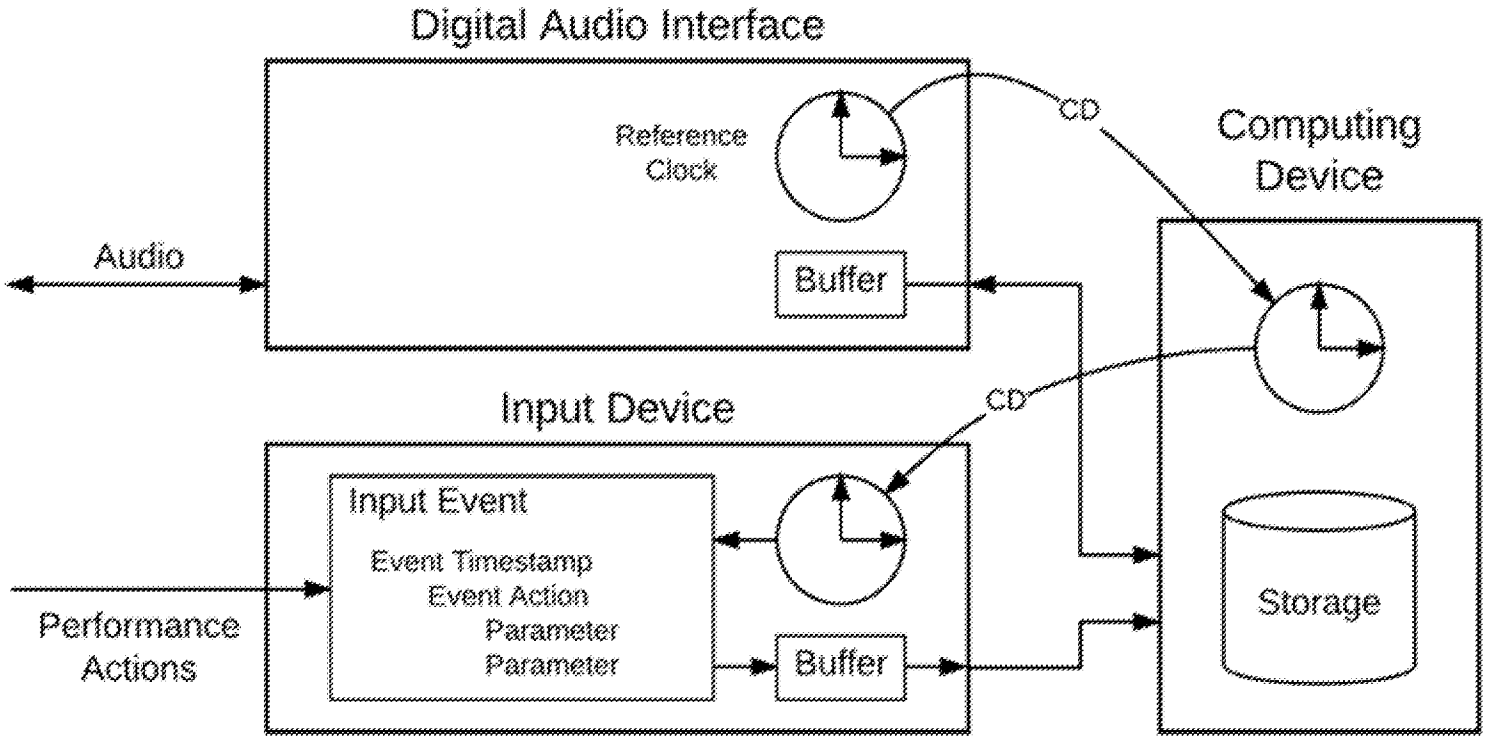
FIG. 10 depicts an example implementation wherein a dedicated audio interface peripheral is coupled to the computing device and the digital audio clock of the peripheral is used as the reference clock, in accordance with an embodiment of the present disclosure.

FIG. 10 depicts an example implementation wherein a dedicated audio interface peripheral is coupled to the computing device and the digital audio clock of the peripheral is used as the reference clock, in accordance with an embodiment of the present disclosure. The clock local to the computing device and the clock local to the input device may be disciplined to follow the peripheral digital audio clock using CD signals.

Figure 11:
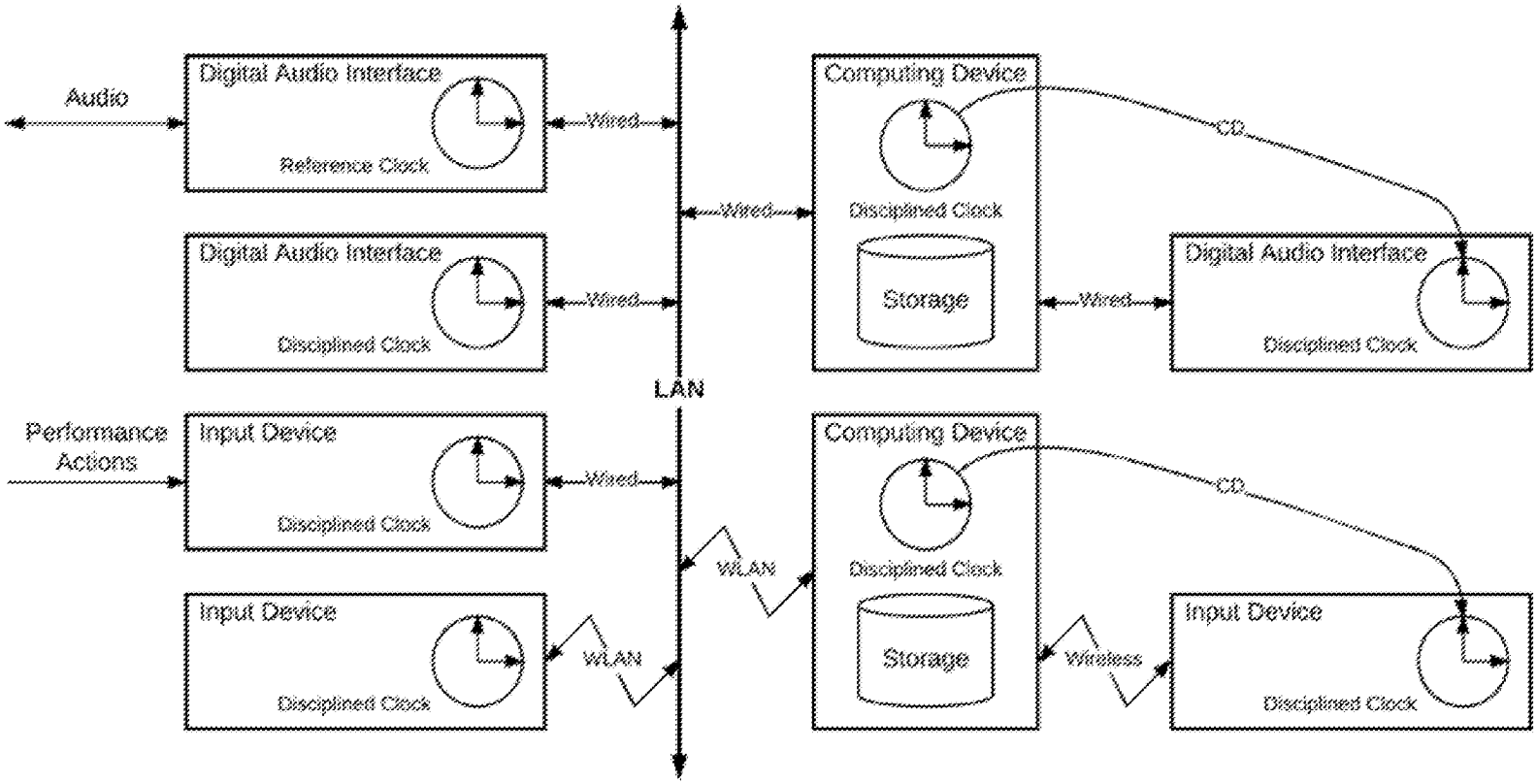
FIG. 11 depicts a subset of devices with direct connections to a computing device and a subset of devices with a network-based connection to a computing device, in accordance with various aspects of the present disclosure.

FIG. 11 depicts a subset of devices with direct connections to a computing device and a subset of devices with a network-based connection to a computing device, in accordance with various aspects of the present disclosure. As described in further detail below, directly connected devices may be connected using a wired or wireless connection. Similarly, network connected devices may be connected with a wired or a wireless connection. In the example depicted in FIG. 11, the clock local to the computing devices may be disciplined to follow an elected network reference clock. The clocks local to devices directly connected to a computing device may be disciplined to follow the local clock of the computing device. Accordingly, the local clock of the directly attached device is indirectly disciplined to follow the elected network reference clock.

In FIG. 11, devices with direct connections to a computing device may be connected with a wired connection (e.g., USB, Thunderbolt, etc.) or with a wireless connection (e.g., Bluetooth). Similarly, network (LAN) connected devices may be connected with a wired connection (e.g., Ethernet) or with a wireless connection (e.g., WiFi). For devices connected to the network, the clock discipline process occurs using a standardized protocol such as IEEE 1588/PTP (precision time protocol). For devices directly connected to a computing device, the clock discipline process may occur at the device driver level of that host computing device.

Figure 12:
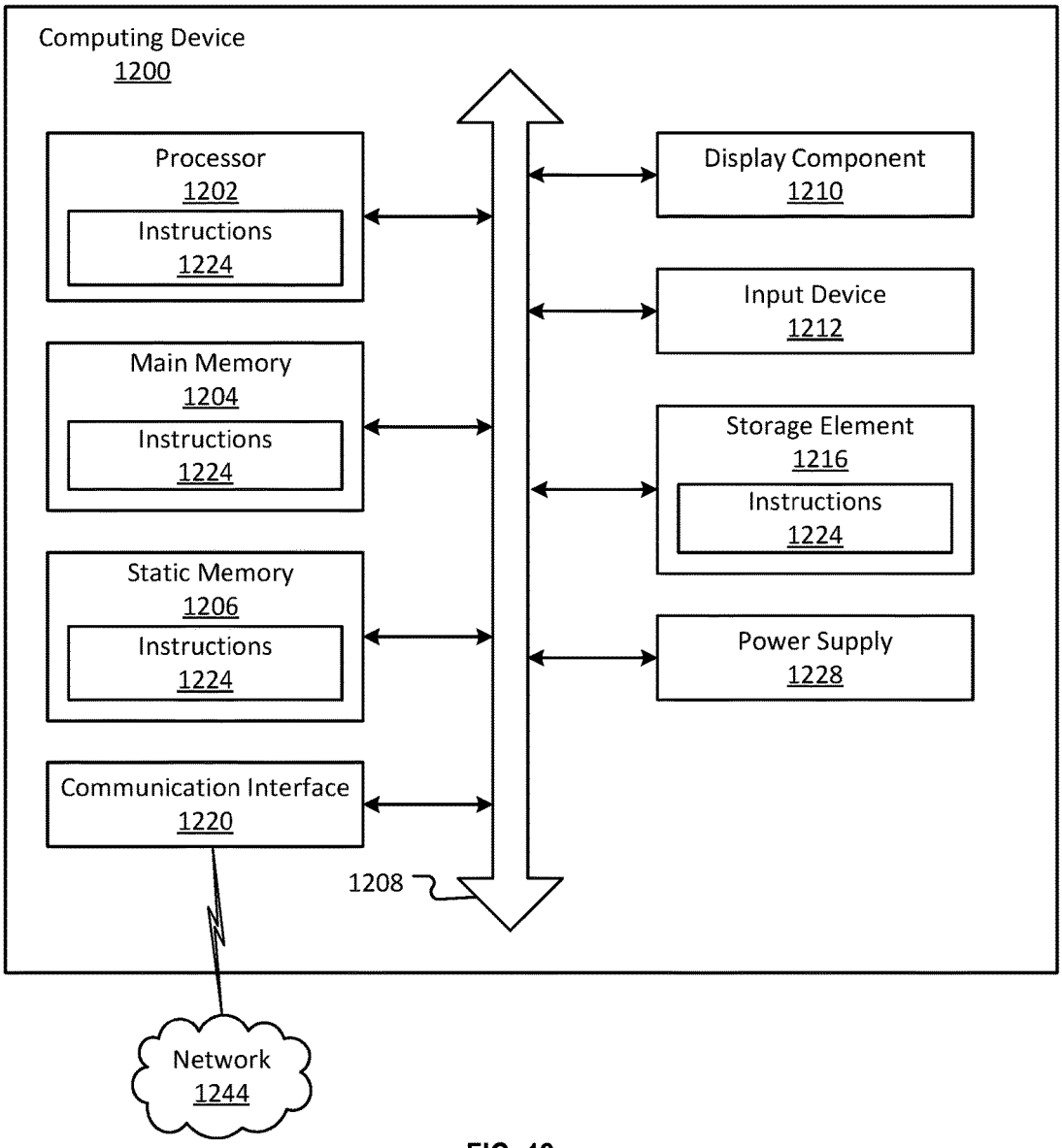
FIG. 12 depicts a computing device that may be used to implement various embodiments of the present disclosure.

Referring to FIG. 12, the block diagram illustrates components of a computing device 1200, according to some example embodiments, able to read instructions 1224 from a non-transitory machine-readable storage medium (e.g., a hard drive storage system) and perform any one or more of the methodologies discussed herein, in whole or in part. Specifically, FIG. 12 shows the computing device 1200 in the example form of a computer system within which the instructions 1224 (e.g., software, a program, an application, an applet, an app, or other executable code) for causing the computing device 1200 to perform any one or more of the methodologies discussed herein may be executed, in whole or in part.

In alternative embodiments, the computing device 1200 operates as a standalone device or may be connected (e.g., networked) to other computing devices. In a networked deployment, the computing device 1200 may operate in the capacity of a server computing device or a client computing device in a server-client network environment, or as a peer computing device in a distributed (e.g., peer-to-peer) network environment. The computing device 1200 may include hardware, software, or combinations thereof, and may, as example, be a server computer, a client computer, a personal computer (PC), a tablet computer, a laptop computer, a netbook, a cellular telephone, a smartphone, a set-top box (STB), a personal digital assistant (PDA), a web appliance, a network router, a network switch, a network bridge, or any computing device capable of executing the instructions 1224, sequentially or otherwise, that specify actions to be taken by that computing device. Further, while only a single computing device 1200 is illustrated, the term "computing device" shall also be taken to include any collection of computing devices that individually or jointly execute the instructions 1224 to perform all or part of any one or more of the methodologies discussed herein.

The computing device 1200 includes a processor 1202 (e.g., a central processing unit (CPU), a graphics processing unit (GPU), a digital signal processor (DSP), an application specific integrated circuit (ASIC), a radio-frequency integrated circuit (RFIC), or any suitable combination thereof), a main memory 1204, and a static memory 1206, which are configured to communicate with each other via a bus 1208. The processor 1202 may contain microcircuits that are configurable, temporarily or permanently, by some or all of the instructions 1224 such that the processor 1202 is configurable to perform any one or more of the methodologies described herein, in whole or in part. For example, a set of one or more microcircuits of the processor 1202 may be configurable to execute one or more modules (e.g., software modules) described herein.

The computing device 1200 may further include a display component 1210. The display component 1210 may comprise, for example, one or more devices such as cathode ray tubes (CRTs), liquid crystal display (LCD) screens, gas plasma-based flat panel displays, LCD projectors, or other types of display devices.

The computing device 1200 may include one or more input devices 1212 operable to receive inputs from a user. The input devices 1212 can include, for example, a push button, touch pad, touch screen, wheel, joystick, keyboard, mouse, trackball, keypad, accelerometer, light gun, game controller, or any other such device or element whereby a user can provide inputs to the computing device 1200. These input devices 1212 may be physically incorporated into the computing device 1200 or operably coupled to the computing device 1200 via wired or wireless interface. For computing devices with touchscreen displays, the input devices 1212 can include a touch sensor that operates in conjunction with the display component 1210 to permit users to interact with the image displayed by the display component 1210 using touch inputs (e.g., with a finger or stylus).

The computing device 1200 may also include at least one communication interface 1220, comprising one or more wireless components operable to communicate with one or more separate devices within a communication range of the particular wireless protocol. The wireless protocol can be any appropriate protocol used to enable devices to communicate wirelessly, such as Bluetooth, cellular, IEEE 802.11, or infrared communications protocols, such as an IrDA-compliant protocol. It should be understood that the communication interface 1220 may also or alternatively comprise one or more wired communications interfaces for coupling and communicating with other devices.

The computing device 1200 may also include a power supply 1228, such as, for example, a rechargeable battery operable to be recharged through conventional plug-in approaches or through other approaches, such as capacitive charging. Alternatively, the power supply 1228 may comprise a power supply unit which converts AC power from the power grid to regulated DC power for the internal components of the device 1200.

The computing device 1200 may also include a storage element 1216. The storage element 1216 includes the machine-readable medium on which are stored the instructions 1224 embodying any one or more of the methodologies or functions described herein. The instructions 1224 may also reside, completely or at least partially, within the main memory 1204, within the processor 1202 (e.g., within the processor's cache memory), or both, before or during execution thereof by the computing device 1200. The instructions 1224 may also reside in the static memory 1206.

Accordingly, the main memory 1204 and the processor 1202 may also be considered machine-readable media (e.g., tangible and non-transitory machine-readable media). The instructions 1224 may be transmitted or received over a network 1244 via the communication interface 1220. For example, the communication interface 1220 may communicate the instructions 1224 using any one or more transfer protocols (e.g., HTTP).

The computing device 1200 may be implemented as any of a number of electronic devices, such as a tablet computing device, a smartphone, a media player, a portable gaming device, a portable digital assistant, a laptop computer, or a desktop computer. In some example embodiments, the computing device 1200 may have one or more additional input components (e.g., sensors or gauges) (not shown). Examples of such input components include an image input component (e.g., one or more cameras), an audio input component (e.g., a microphone), a direction input component (e.g., a compass), a location input component (e.g., a GPS receiver), an orientation component (e.g., a gyroscope), a motion detection component (e.g., one or more accelerometers), an altitude detection component (e.g., an altimeter), and a gas detection component (e.g., a gas sensor). Inputs harvested by any one or more of these input components may be accessible and available for use by any of the modules described herein.

As used herein, the term "memory" refers to a non-transitory machine-readable medium capable of storing data temporarily or permanently and may be taken to include, but not be limited to, random-access memory (RAM), read-only memory (ROM), buffer memory, flash memory, and cache memory. The machine-readable medium is non-transitory in that it does not embody a propagating signal. While the machine-readable medium is described in example embodiments as a single medium, the term "machine-readable medium" should be taken to include a single medium or multiple media (e.g., a centralized or distributed database, or associated caches and servers) able to store instructions 1224. The term "machine-readable medium" shall also be taken to include any medium, or combination of multiple media, that is capable of storing the instructions 1224 for execution by the computing device 1200, such that the instructions 1224, when executed by one or more processors of the computing device 1200 (e.g., processor 1202), cause the computing device 1200 to perform any one or more of the methodologies described herein, in whole or in part. Accordingly, a "machine-readable medium" refers to a single storage apparatus or device such as computing devices 110, 130, 140, or 150, as well as cloud-based storage systems or storage networks that include multiple storage apparatus or devices. The term "machine-readable medium" shall accordingly be taken to include, but not be limited to, one or more tangible (e.g., non-transitory) data repositories in the form of a solid-state memory, an optical medium, a magnetic medium, or any suitable combination thereof.

Figure 13:
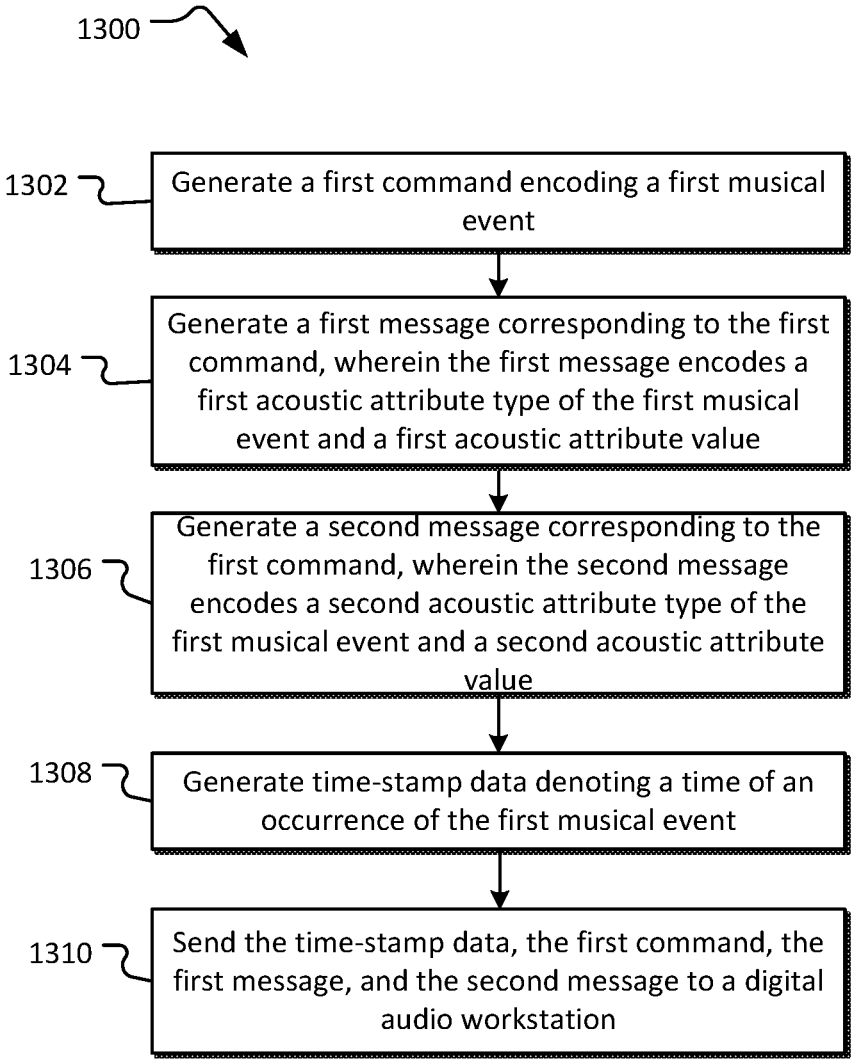
FIG. 13 depicts a flow chart illustrating a process that may be used in accordance with various aspects of the present disclosure.

FIG. 13 depicts a flow chart illustrating an example process that may be used in accordance with various aspects of the present disclosure. In at least some examples, the actions of the process flow 1300 may represent a series of instructions comprising computer readable machine code executable by a processing unit of a computing device. In various examples, the computer readable machine codes may be comprised of instructions selected from a native instruction set of the computing device and/or an operating system of the computing device. In various other examples, one or more actions of process flow 1300 may be performed by hardware such as an application specific integrated circuit (ASIC) or a programmable circuit. In some further examples, one or more of the actions of process flow 1300 may be executed by some combination of hardware and computer-readable instructions. Additionally, in at least some examples, the actions of process flow 1300 may be performed in different orders apart from what is shown and described in reference to FIG. 13.

In some examples, the process flow 1300 may begin with action 1302, "Generate a first command encoding a first musical event". At action 1302, a computing device, such as input device 102 described above in reference to FIG. 1, may generate a first command encoding a first musical event. In various examples, the command may be a chainable command, such as the "note on" commands and various other chainable commands described herein.

The process flow 1300 may continue from action 1302 to action 1304, "Generate a first message corresponding to the first command, wherein the first message encodes a first acoustic attribute type of the first musical event and a first acoustic attribute value." At action 1304, a computing device, such as input device 102 described above in reference to FIG. 1, may generate a first message corresponding to the first command. The first message may be, for example, a command selected from a command table, such as command table 400 depicted in FIG. 4. In various examples, the first message may encode various attributes of the first musical event. For example, the first message may encode a first acoustic attribute type of the first musical event and a first acoustic attribute value of the first musical event. In another example, the first acoustic attribute type may specify a type of command such as "initial pitch", "loudness", "pitch bend", etc. In the example, the first acoustic attribute value may specify a value for the first acoustic attribute type. For example, if the first acoustic attribute type is "loudness" the first acoustic attribute value may encode a loudness of the note for playback of the first musical event.

The process flow 1300 may continue from action 1304 to action 1306, "Generate a second message corresponding to the first command, wherein the second message encodes a second acoustic attribute type of the first musical event and a second acoustic attribute value." At action 1306, a computing device, such as input device 102 described above in reference to FIG. 1, may generate a second message corresponding to the first command. The second message may be, for example, a command selected from a command table, such as command table 400 depicted in FIG. 4. In various examples, the second message may encode various attributes of the first musical event. For example, the second message may encode a second acoustic attribute type of the first musical event and a second acoustic attribute value of the first musical event. In another example, the second acoustic attribute type may specify a type of command such as "initial pitch", "note duration", "pitch bend", etc. In the example, the second acoustic attribute value may specify a value for the second acoustic attribute type. For example, if the first acoustic attribute type is "initial pitch" the first acoustic attribute value may encode a pitch (e.g., a frequency value) of the note of the first musical event.

The process flow 1300 may continue from action 1306 to action 1308, "Generate timestamp data denoting a time of an occurrence of the first musical event." At action 1308, the computing device (e.g., a musical instrument and/or controller comprising a processor) may generate timestamp data denoting a time of an occurrence of the first musical event. As described above, the timestamp data may describe a time at which the first musical event (as encoded by the first command, the first message and the second message) is captured or should be played back in a performance of the first musical event. In at least some examples, the timestamp data may be generated contemporaneously (or nearly contemporaneously) with the capturing of performance data and with the generation of the various commands and messages described in the present disclosure.

The process flow 1300 may continue from action 1308 to action 1310, "Send the timestamp data, the first command, the first message, and the second message to a digital audio workstation." At action 1310, the first command (e.g., a chainable "note on" command), the first message (e.g., a message encoding a duration of the note of the "note on" command), the second message (e.g., a message encoding an initial pitch of the note of the "note on" command) and the timestamp data may be sent to a DAW. The timestamp data may specify a time at which the first command, first message and second message should be played back to reproduce the first musical event.

While the invention has been described in terms of particular embodiments and illustrative figures, those of ordinary skill in the art will recognize that the invention is not limited to the embodiments or figures described. For example, in various embodiments described above, encoding of musical performance data is described. However, in other embodiments, the other types of data may be encoded in accordance with the various techniques described herein. For example, lighting, choreography and other data requiring precise timings may be encoded in accordance with the various techniques described herein. Additionally, although particular musical attributes such as pitch and note duration are described herein, those of ordinary skill in the art will recognize that various other parameters of musical performances may be encoded, in accordance with the various techniques described herein.

In various examples and among other potential benefits, the various techniques described herein improve the technical field of capturing and playing back musical performance data. For example, the particular structured representations of the performance data described herein as well as the timestamping techniques described herein allow musical performance data to be captured with a high degree of temporal precision and spatial precision relative to current techniques. Additionally, the methods and systems described herein may allow increased expressiveness of musical performance data to be captured and played back.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show details of the invention in more detail than is necessary for the fundamental understanding of the invention, the description taken with the drawings and/or examples making apparent to those skilled in the art how the several forms of the invention may be embodied in practice.

As used herein and unless otherwise indicated, the terms "a" and "an" are taken to mean "one," "at least one" or "one or more." Unless otherwise required by context, singular terms used herein shall include pluralities and plural terms shall include the singular.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural and singular number, respectively. Additionally, the words "herein," "above," and "below" and words of similar import, when used in this application, shall refer to this application as a whole and not to any particular portions of the application.

The description of embodiments of the disclosure is not intended to be exhaustive or to limit the disclosure to the precise form disclosed. While specific embodiments and examples for the disclosure are described herein for illustrative purposes, various equivalent modifications are possible within the scope of the disclosure, as those skilled in the relevant art will recognize. Such modifications may include, but are not limited to, changes in the dimensions and/or the materials shown in the disclosed embodiments.

Specific elements of any embodiments can be combined or substituted for elements in other embodiments. Furthermore, while advantages associated with certain embodiments of the disclosure have been described in the context of these embodiments, other embodiments may also exhibit such advantages, and not all embodiments need necessarily exhibit such advantages to fall within the scope of the disclosure.

Therefore, it should be understood that the invention can be practiced with modification and alteration within the spirit and scope of the appended claims. The description is not intended to be exhaustive or to limit the invention to the precise form disclosed. It should be understood that the invention can be practiced with modification and alteration and that the invention be limited only by the claims and the equivalents thereof.

What is claimed is:

1. A method of capturing musical performance data, the method comprising:

generating, by a musical input device comprising a processor, a first command encoding a first musical event;

generating, by the musical input device, a first message corresponding to the first command, wherein the first message encodes a first acoustic attribute type of the first musical event and a first acoustic attribute value, wherein the first acoustic attribute value specifies a first value of the first acoustic attribute type;

generating, by the musical input device, a second message corresponding to the first command, wherein the second message encodes a second acoustic attribute type of the first musical event and a second acoustic attribute value, wherein the second acoustic attribute value specifies a second value of the second acoustic attribute type;

generating, by the musical input device, timestamp data denoting a time of an occurrence of the first musical event, the timestamp data corresponding to the first message and the second message; and sending the timestamp data, the first command, the first message, and the second message to a computing device.

2. The method of claim 1, wherein the first command comprises first chain data comprising an indication of a number of messages corresponding to the first command.

3. The method of claim 1, wherein the first command comprises a "note on" command, which when received by an external sound generator, causes the external sound generator to play a musical note.

4. The method of claim 3, wherein the first message comprises articulation instructions encoding an articulation of the musical note.

5. The method of claim 1, wherein the timestamp data comprises a first data word encoding seconds and a second data word encoding fractions of seconds.

6. The method of claim 1, wherein the musical input device comprises a musical instrument.

7. The method of claim 1, wherein the musical input device comprises a stringed instrument, the method further comprising:

generating the first command for a first sub-channel of the musical performance data, wherein the first musical event comprises a first note played on a first string of the stringed instrument; and generating a second command for a second sub-channel of the musical performance data, the second command encoding a second musical event, wherein the second musical event comprises a second note played on a second string of the stringed instrument.

8. The method of claim 7, wherein:

the musical performance data of the stringed instrument is generated for a first channel;

the first channel comprises the first sub-channel and the second sub-channel; and the timestamp data associates the second musical event with the time of the occurrence of the first musical event.

9. The method of claim 1, further comprising:

generating, by the musical input device, a second command, the second command encoding a second musical event, wherein the timestamp data associates the second command with the time of the occurrence of the first musical event.

10. The method of claim 9, further comprising:

generating, by the musical input device, a third message corresponding to the second command, wherein the third message encodes a third acoustic attribute type of the second musical event and a third acoustic attribute value, wherein the third acoustic attribute value specifies a third value of the third acoustic attribute type, and wherein the third message uses a first number of bits to encode the third acoustic attribute type and a second number of bits to encode the third acoustic attribute value associated with the third acoustic attribute type.

11. A musical instrument comprising:

at least one processor; and at least one sensor effective to detect an input representing a musical event;

the at least one processor effective to:

generate a command comprising a digital representation of the musical event based on the input, the digital representation comprising:

a first message encoding a first acoustic attribute type and a first acoustic attribute value, wherein the first acoustic attribute value specifies a first value of the first acoustic attribute type; and a second message encoding a second acoustic attribute type and a second acoustic attribute value, wherein the second acoustic attribute value specifies a second value of the second acoustic attribute type;

generate timestamp data associated with a timing of the digital representation of the musical event; and send the digital representation and the timestamp data to a computing device, wherein the computing device is effective to store and edit the digital representation of the musical event.

12. The musical instrument of claim 11, wherein the digital representation comprises a "note on" command, which when received by an external sound generator, causes the external sound generator to play a musical note at the timing associated with the timestamp data.

13. The musical instrument of claim 12, wherein the first message corresponds to the "note on" command and the second message corresponds to the "note on" command.

14. The musical instrument of claim 13, wherein the first message and the second message are associated with the timing of the timestamp data.

15. The musical instrument of claim 11, wherein the timestamp data comprises a first data word encoding seconds and a second data word encoding fractions of seconds.

16. The musical instrument of claim 11, wherein the at least one processor is further effective to synchronize a first clock of the at least one processor with a second clock of the computing device.

17. A computing device comprising:

at least one processor;

a sensor effective to detect a performance action;

a non-transitory computer-readable medium storing instructions that, when executed by the at least one processor are effective to perform a method comprising:

generating a first command, the first command encoding a first musical event associated with the performance action;

generating a first message corresponding to the first command, wherein the first message encodes a first acoustic attribute type of the first musical event;

generating a second message corresponding to the first command, wherein the second message encodes a second acoustic attribute type of the first musical event;

generating timestamp data denoting a time of an occurrence of the first musical event, the timestamp data corresponding to the first message and the second message; and sending the timestamp data, the first command, the first message, and the second message to a second computing device.

18. The computing device of claim 17, wherein the timestamp data comprises a first data word encoding seconds and a second data word encoding fractions of seconds.

19. The computing device of claim 17, wherein the first command comprises first chain data comprising an indication of a number of messages corresponding to the first command.

20. The computing device of claim 17, wherein:

the first command comprises a "note on" command, which when received by an external sound generator, causes the external sound generator to play a musical note; and the first acoustic attribute type comprises a command specifying an initial pitch of the musical note.

* * * * *